US007554047B2

(12) United States Patent
Verdu et al.

(10) Patent No.: US 7,554,047 B2
(45) Date of Patent: Jun. 30, 2009

(54) LIGHTED PUSHBUTTON-TYPE SWITCH ASSEMBLY

(75) Inventors: Juan José Verdu, Barcelona (ES); Miguel Angel Lorenzo, Barcelona (ES)

(73) Assignee: Industrias Lorenzo, SA, Sant Climent De Llobregat, Barcelona (ES)

( * ) Notice: Subject to any disclaimer, the term of this patent is extended or adjusted under 35 U.S.C. 154(b) by 83 days.

(21) Appl. No.: 11/731,986

(22) Filed: Apr. 2, 2007

(65) Prior Publication Data

US 2007/0246337 A1 Oct. 25, 2007

(30) Foreign Application Priority Data

Apr. 25, 2006 (EP) ..... 06380092

(51) Int. Cl.
*H01H 3/12* (2006.01)

(52) U.S. Cl. ..... 200/314; 200/341

(58) Field of Classification Search ..... 200/16 R–16 D, 200/520, 533, 534, 310–315, 341–345
See application file for complete search history.

(56) References Cited

U.S. PATENT DOCUMENTS 4,254,315 A * 3/1981 Stevens ..... 200/524
4,419,555 A * 12/1983 Kim ..... 200/314
4,683,359 A * 7/1987 Wojtanek ..... 200/314
4,742,198 A * 5/1988 Martin et al. ..... 200/296
5,399,820 A 3/1995 Silfvast
6,310,308 B1 * 10/2001 Watson et al. ..... 200/520
6,590,176 B2 * 7/2003 Cole et al. ..... 200/341
6,747,226 B2 * 6/2004 Watanabe ..... 200/520
6,762,381 B2 * 7/2004 Kunthady et al. ..... 200/512
6,781,076 B2 * 8/2004 Takiguchi et al. ..... 200/316
6,809,273 B2 * 10/2004 Ito et al. ..... 200/5 R
6,858,812 B2 * 2/2005 Sasaki et al. ..... 200/344
6,870,114 B2 * 3/2005 Cole et al. ..... 200/341
6,984,797 B2 * 1/2006 Morita et al. ..... 200/314
6,987,233 B2 * 1/2006 Cole et al. ..... 200/341
7,005,596 B2 * 2/2006 Maeda et al. ..... 200/314
7,075,024 B2 * 7/2006 Maeda et al. ..... 200/310

FOREIGN PATENT DOCUMENTS

EP 1 217 291 A2 6/2002

* cited by examiner

*Primary Examiner*—Michael A Friedhofer
*Assistant Examiner*—Lisa N Klaus
(74) *Attorney, Agent, or Firm*—RatnerPrestia

(57) ABSTRACT

The invention relates to a lighted pushbutton-type switch assembly which comprises a base body adapted to be secured to a panel and a support board carrying a connector and a switch connected to a circuit. The support board is adapted to be fixed to the base body. An actuating assembly is mounted in a linearly movable fashion on said base body to operate said switch. A light source is mounted on an auxiliary board secured to the base body and connected to conductors terminated in contacts arranged on a region adjacent to the edge of the auxiliary board and adapted to be coupled to said connector in order to connect said contacts to the circuit. The light source is arranged to emit light through a translucent or transparent cover on the actuating assembly.

11 Claims, 4 Drawing Sheets

LIGHTED PUSHBUTTON-TYPE SWITCH ASSEMBLY

TECHNICAL FIELD

The present invention relates to a lighted pushbutton-type switch assembly applicable to recreational, dispensing and similar machines.

STATE OF THE PREVIOUS ART

Examples are known of lighted pushbutton-type switch assemblies comprising a base body adapted to be secured to a panel and an actuating assembly mounted on said base body so that it can moved between an extended position and a retracted position, with an elastic element arranged to push said actuating assembly towards the mentioned extended position. The actuating assembly is adapted to be depressed against the force of this elastic element in order to operate a switch fixed to the base body and connected to an electronic system. At least one lighting element is installed inside the base body and connected to said electronic system and arranged to emit light through said actuating assembly, which is translucent or transparent to this purpose.

It is usual for the base body to comprise a shank at the top of which is defined a bezel adapted to house a pushbutton of the actuating assembly. The mentioned bezel has a rear surface adapted to rest on an exposed side of the mentioned panel, with the shank passing through a hole in the panel, towards a hidden side of the same. The shank has an exterior configuration adapted to secure the base body to the panel and the actuating assembly comprises an actuator appendix that extends downwards from the pushbutton through a passage along the length of the base body shank in order to operate said switch, which is mounted on a support part secured to the lower end of the shank. The mentioned lighting element may be formed by an incandescent bulb or one or more Light-Emitting Diodes (LEDs) mounted on a lamp-holder fixed to said support part.

Alternatively, the switch is mounted on a printed circuit board secured by snap-fit coupling to the lower end of the shank, and one or more LEDs installed on a circuit of the printed circuit board. Although this construction is practical with respect to the installation of the switch and the printed circuit board to the base body, it has a drawback in that the LEDs, owing their low height, are at a distance far away from the pushbutton.

U.S. Pat. No. 5,399,820 describes a pushbutton-type switch assembly comprising a first printed circuit board, fixed at a distance from the hidden side of a panel, and an LED mounted of the circuit of said first printed circuit board. A second printed circuit board is fixed below the first one at a distance therefrom and a switch is mounted on the circuit of said second printed circuit board. A cover is arranged through a hole in said panel above the LED and the first printed circuit board, said cover being connected by means of pins inserted through holes to an actuator plate arranged below the first printed circuit board and above the switch and the second printed circuit board. By pressing the cover downwards it is possible to operate the switch. The first printed circuit board contains holes aligned with guide holes provided in a guide body secured to the first printed circuit board around the LED.

This construction results in a relatively complex installation and the connections between the first and second printed circuit boards must, presumably, be made by a wiring, which still further increases the assembly complexity.

U.S. Pat. No. 6,310,308 describes a pushbutton-type switch assembly for installation on a printed circuit that carries a contact switch fixed to the same. The pushbutton-type switch assembly comprises a base body adapted to be fixed to the printed circuit board. The base body has an interior cavity dimensioned and configured to house the contact switch inside and an upper surface holding the electrical circuitry, and a light source, such as a LED, connected to said circuitry which, in turn, is connected to the printed circuit board circuit. Inside the inner cavity of the base body there is an actuator in contact with the contact switch and over the base body is arranged a cover defining an interior cavity, wherein an upper part of the cover defines a pushbutton and a lower part of the interior cavity is adapted to slidingly receive the base body, with the cover being in contact with the actuator.

The base body raises the light source with respect to the printed circuit board, brings it close to the cover and ensures a path that is free from obstacles between the light source and the cover. The connection of the base body to the printed circuit board is made by inserting snugs provided on the base body into holes provided in the printed circuit board. However, the electrical connection between the base body circuitry and the printed circuit board is presumably carried out by soldering, which is not very practical or adaptable.

Patent EP-A-1217291 describes a lamp assembly composed of one or more LEDs soldered to a printed circuit board. The printed circuit board includes contacts in a region adjacent to an edge adapted for coupling into a lamp-holder. The lamp assembly may be used to replace a conventional plug-in bulb. The mentioned region of the printed circuit board may be constructed so that it can only be coupled to the lamp-holder in one position, or it may employ circuitry that will permit connection in any of the two positions.

DESCRIPTION OF THE INVENTION

One aspect of the present invention is a lighted pushbutton-type switch assembly provided with a switch mounted on a printed circuit board fixed to the lower end of the base body, and a device to locate a light source close to a translucent or transparent cover of an actuating assembly of the pushbutton-type switch assembly, said light source being connected to said printed circuit board circuit and where the printed circuit board and the switch, as well as its connections with the light source are easily mounted and dismounted.

The present invention contributes to achieve the previous and other aspects by providing a lighted pushbutton-type switch assembly of the type comprising a base body adapted to be fixed to a panel, a support board bearing a circuit and a switch connected to said circuit, where said support board is adapted to be positioned with respect to said base body and secured to the same, an actuating assembly mounted in a linearly moveable fashion on said base body and adapted to be pressed in order to operate said switch, and a light source in connection with said support board circuit and arranged to emit light through a translucent or transparent cover on said actuating assembly. The pushbutton-type switch assembly according to the present invention is characterised in that said light source is mounted on an auxiliary board adapted to be positioned with respect to the base body and secured to the same. The mentioned auxiliary board has conductors connected to said light source and terminated in contacts arranged on a region adjacent to an edge of said auxiliary board. The support board includes a connector comprising a receptacle with terminals connected to said circuit. The mentioned region of the auxiliary board having said contacts is adapted to be inserted into said receptacle of said connector in order to connect said contacts to said terminals when the auxiliary board is fixed to the base body and the support board is positioned with respect to the base body.

The base body and the auxiliary board comprises respective positioning and securing configurations adapted to mutually cooperate to position and secure the auxiliary board with respect to the base body. The positioning and securing of the support board to the base body is achieved through conventional means. Thus, the auxiliary board remains incorporated into the pushbutton-type switch assembly base body and the region of the same with the contacts acts as a male connector for automatically connecting the light source to the support board circuit when the support board is positioned and secured to the pushbutton-type switch assembly base body. In a preferred exemplary embodiment, the securing means for the support board can be released so that when the support board is separated from the base body, the auxiliary board region where contacts are located is automatically extracted from the support board connector and disconnects the light source from the support board.

The auxiliary board has the function of locating the light source in a position close to the translucent or transparent cover of the actuating assembly. For this reason, the auxiliary board has an elongated shape delimited by two lateral edges and first and second end edges, where the light source is adjacent to the first auxiliary board end edge, which is situated close to the translucent or transparent cover, and the region where the contacts are located is adjacent to the second auxiliary board end edge, which is located so as to couple to the support board connector. When the auxiliary board is positioned and secured to the base body in an operative situation, the auxiliary board is situated in a direction parallel to the movement direction of the actuating assembly in relation to the base body and perpendicular to the support board.

Preferably, both the support and auxiliary boards are printed circuit boards and can easily incorporate additional electrical and/or electronic components.

BRIEF DESCRIPTION OF THE DRAWINGS

The previous and other advantages and features of the present invention will be more fully understood from the following detailed description of an exemplary embodiment, with reference to the accompanying drawings, in which.

DETAILED DESCRIPTION OF AN EXEMPLARY EMBODIMENT

Throughout the following description, the terms "up", "down", upper" and "lower" and their derivatives are in accordance with the position in which the pushbutton-type switch assembly and its components are represented in the figures.

Figure 3:
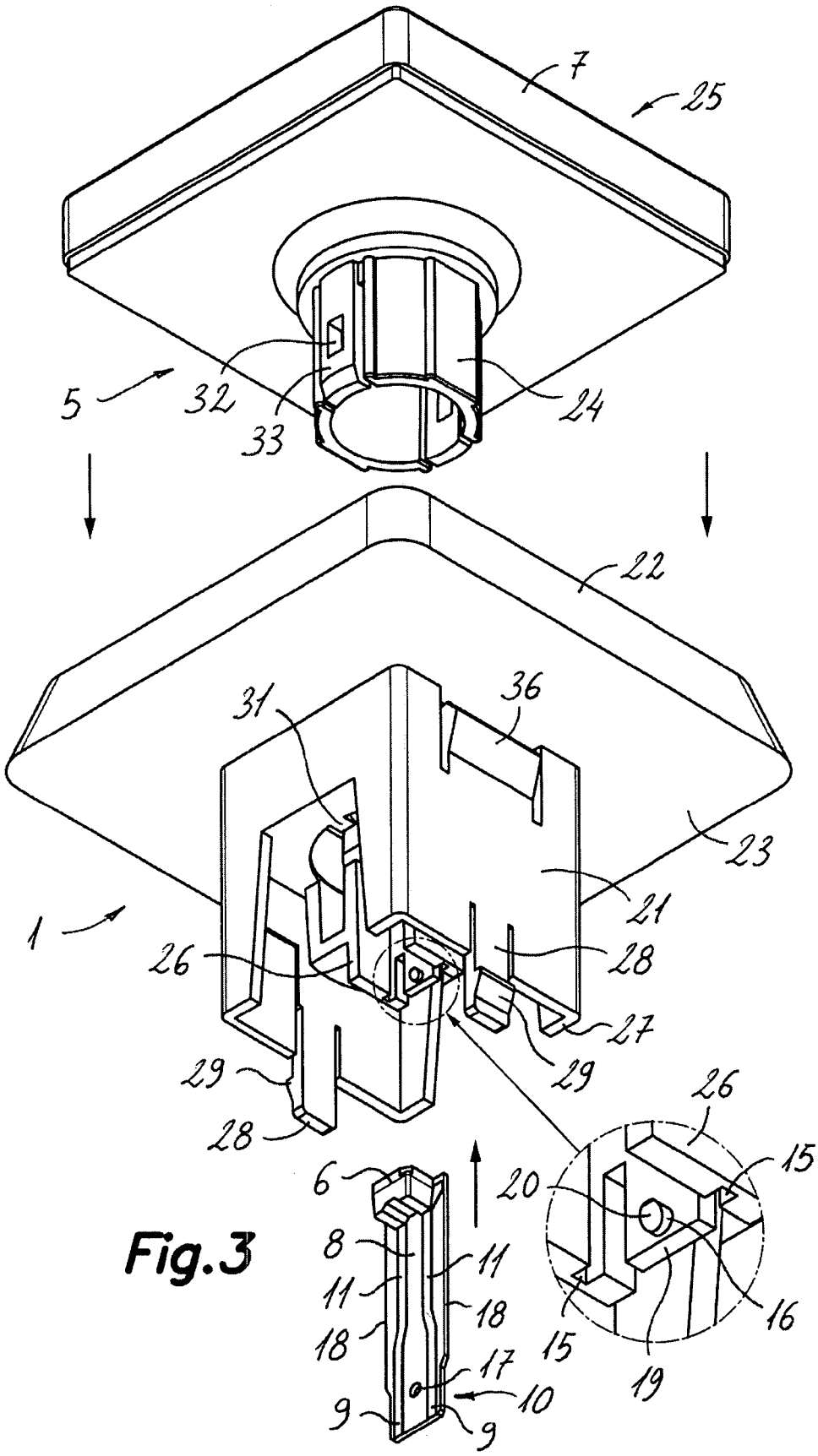
FIG. 3 is an enlarged exploded perspective view, with additional enlarged detail that shows an assembled actuating assembly, a base body and the auxiliary board forming part of the assembly of FIG. 1.
Figure 4:
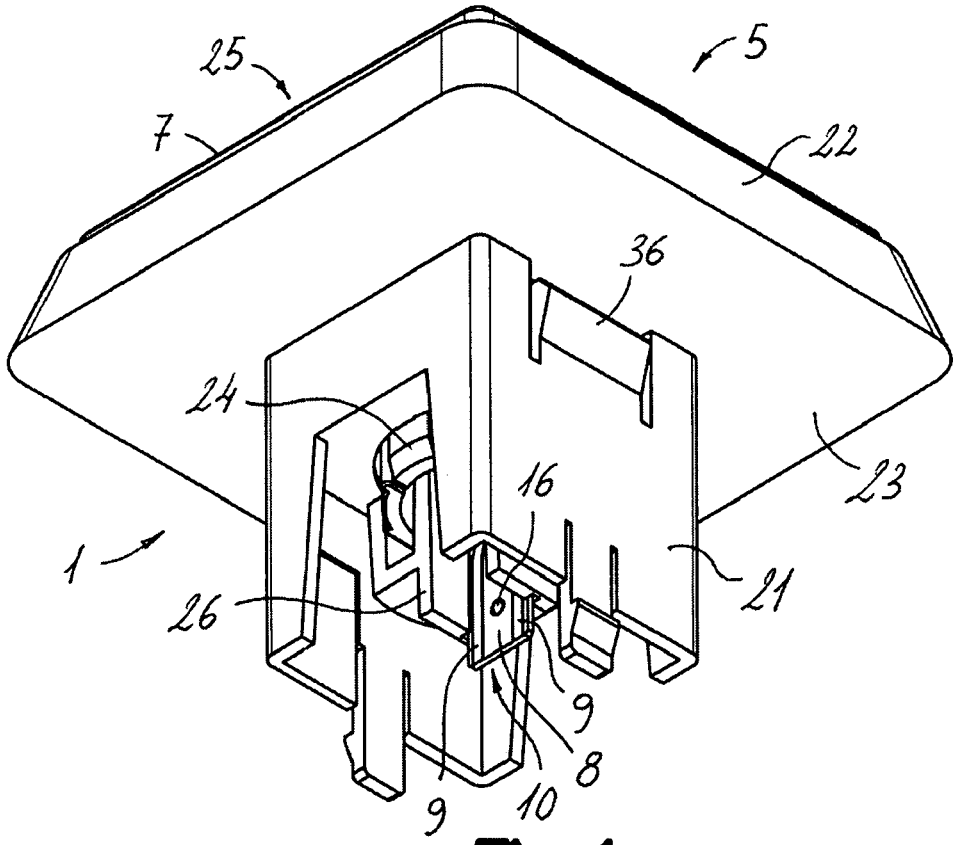
FIG. 4 is an enlarged perspective view showing the elements of FIG. 3 once assembled.
Figure 5:
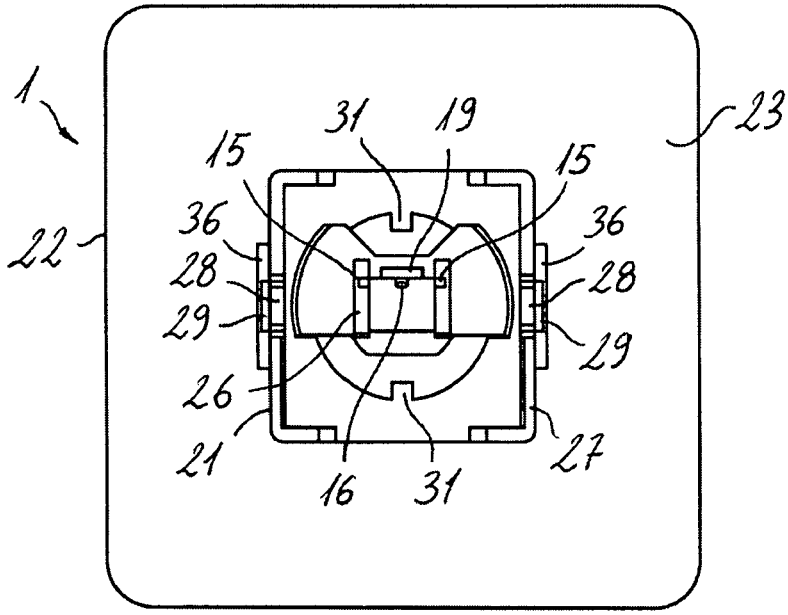
FIG. 5 is a lower plan view of the base body.

Referring to the figures in general, the lighted pushbutton-type switch assembly according to an exemplary embodiment comprises a base body 1 provided with a shank 21 adapted to pass through a hole 35 in a panel 2 (FIG. 6) and a bezel 22 connected to an upper end of said shank 21. The bezel 22 has a rear surface 23 (FIGS. 3 to 5) adapted to be supported on an exposed side of the panel 2 around said hole 35. The base body 1 is adapted to be conventionally secured to said panel 2 by means of protuberances 36 (FIGS. 3 to 5) that protrude from elastic arms formed on the shank 21. Alternatively, the shank 21 can include an outer threading for coupling to a securing nut located on the hidden side of the panel to fix the base body to the panel.

Figure 1:
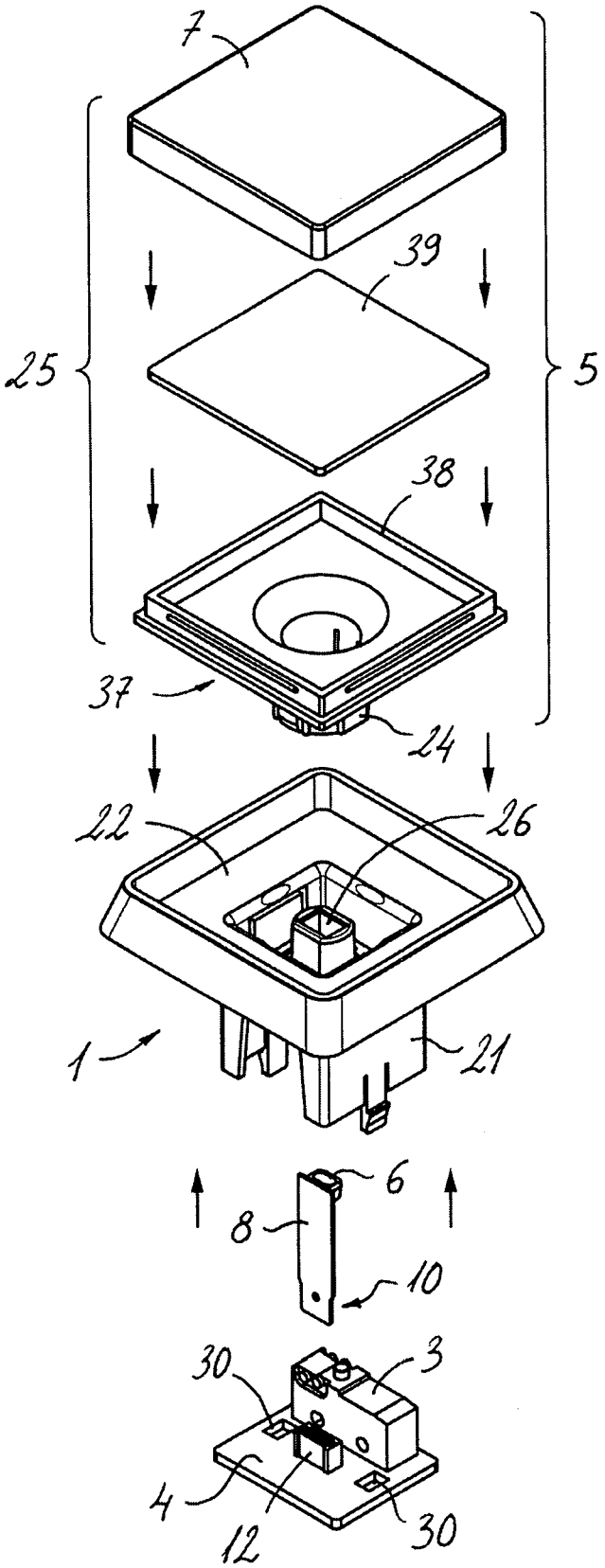
FIG. 1 is an exploded perspective view of the lighted pushbutton-type switch assembly according to an exemplary embodiment of the present invention.
Figure 2:
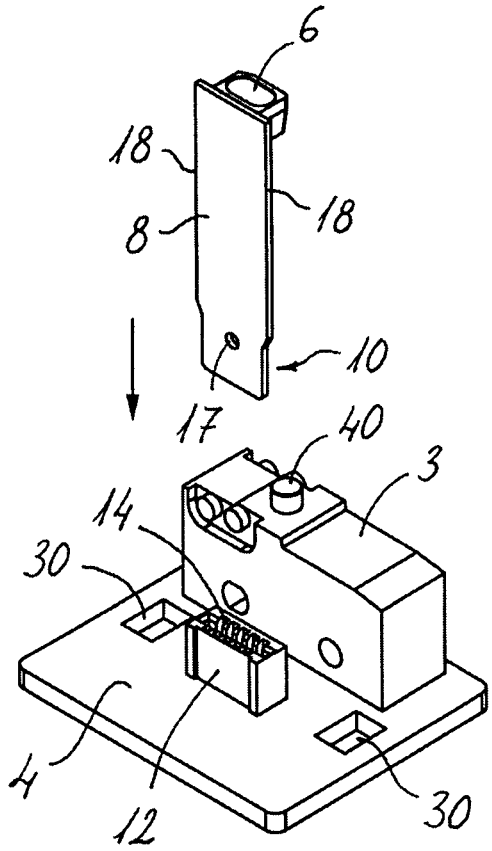
FIG. 2 is an enlarged exploded perspective view showing a support board and an auxiliary board that form part of the assembly of FIG. 1.
Figure 6:
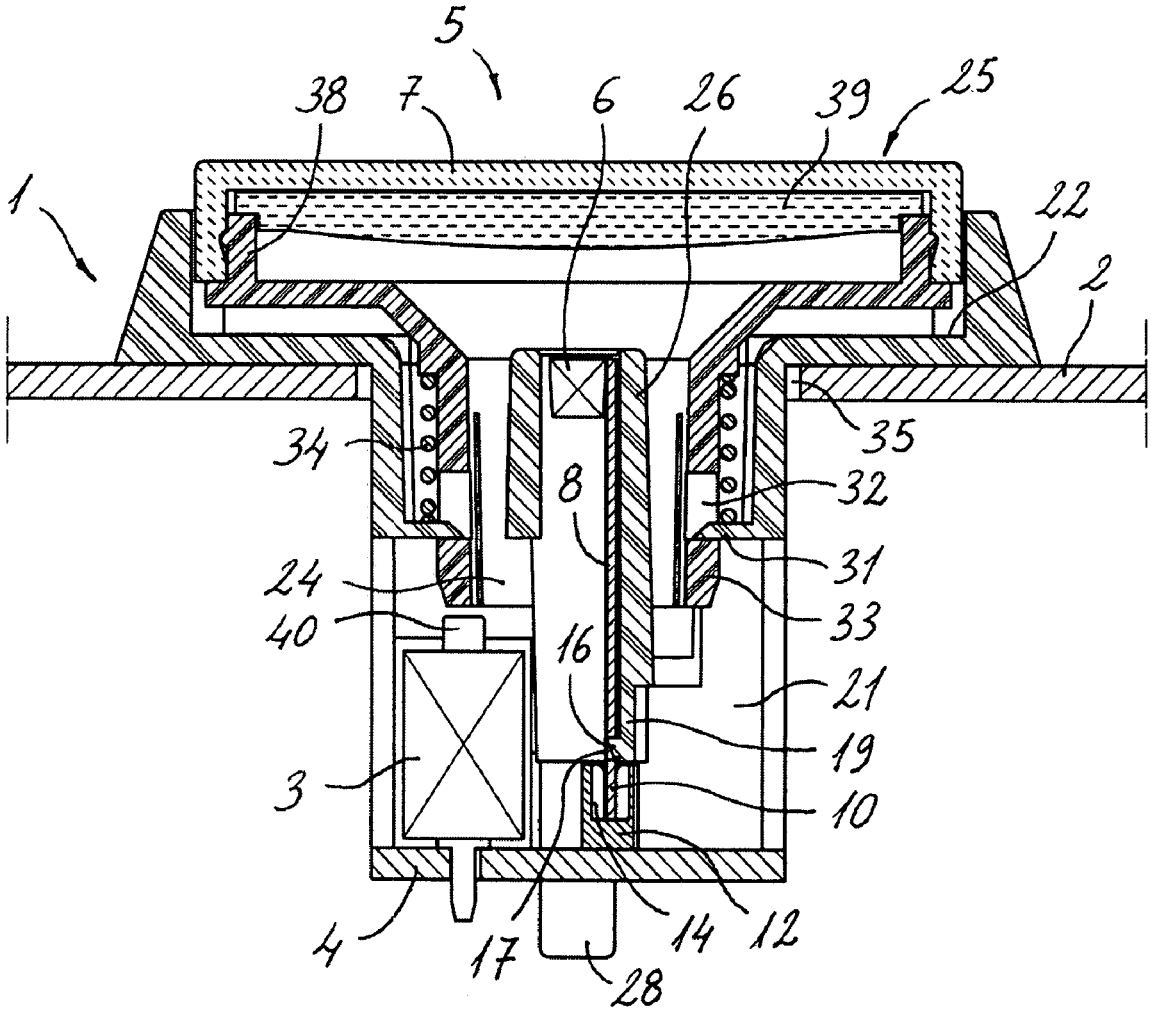
FIG. 6 is a longitudinal section of the lighted pushbutton-type switch assembly once assembled.

At a lower end of the shank 21 of the base body 1 a support board 4 is arranged carrying a circuit, a switch 3 connected to said circuit and a connector 12 comprising a receptacle containing terminals 14 connected to the circuit (FIGS. 1, 2 and 6). This support board 4 can advantageously be a printed circuit board, optionally with additional electrical and/or electronic components. The shank 21 inferiorly terminates in a surface 27 adapted to be supported on the support board 4 and comprising downwards protruding elastic arms 28 provided with respective locking claws 29. The mentioned elastic arms 28 are configured and arranged to cooperate with corresponding holes 30 in the support board 4 to position and secure the support board 4 with respect to the base body 1 by snap fit coupling in a known manner.

The pushbutton-type switch assembly also comprises an actuating assembly 5 formed by an actuator member 37 and a translucent or transparent cover 7. The mentioned actuator member 37 defines a hollow stem 24 adapted to be inserted inside said shank 21 of the base body 1 and an expanded upper portion provided with a perimetral rib 38 adapted to be coupled to said translucent or transparent cover 7 forming a pushbutton 25 adapted to be received, at least partly, inside said bezel 22 of the base body 1. Optionally, there is a conventional translucent or transparent body 39 between said expanded portion of the actuator member 37 and the translucent or transparent cover 7 (FIGS. 1 and 6), for example, in the form of a lens. The coupling of the hollow stem 24 of the actuating assembly 5 inside the shank 21 of the base body 1 is adapted to allow linear movement of the actuating assembly 5 with respect to the base body 1. The base body 1 comprise claws 31 (FIGS. 3 to 6) adapted to cooperate with corresponding elongated holes 32 provided in elastic tabs 33 formed on the hollow stem 24 of the actuating assembly 5 to retain the actuating assembly 5 in the base body 1 and limit the movement path of the actuating assembly 5 with respect to the base body 1 between an extended position (shown in FIG. 6) and a retracted position against the force of an elastic element 34 (FIG. 6). This elastic element 34 may be, for example, a helicoidal spring installed compressed between the actuating assembly 5 and the body base 1 to push the actuating assembly 5 towards said extended position. The hollow stem 24 of the actuating assembly 5 has a lower end arranged to operate an actuator element 40 of said switch 3 (FIG. 6) when said actuating assembly 5 is pushed towards the retracted position.

The pushbutton-type switch assembly of the present invention comprises a light source 6 connected to the circuit of said support board 4 and arranged to emit light through the translucent or transparent cover 7 of the actuating assembly 5. The mentioned light source 6 is mounted on an auxiliary board 8 adapted to be positioned with respect to the base body 1 and secured to the same. This auxiliary board 8 has an elongated shape delimited by two lateral edges 18 and the light source 6 is situated adjacent to a first upper end edge of the auxiliary board 8. The light source 6 is connected to conductors 11 terminating in contacts 9 (FIG. 3) arranged in a region 10 adjacent to a second lower end edge of the auxiliary board 8. The auxiliary board 8 can advantageously be a printed circuit board, optionally with additional electrical and/or electronic components.

The base body 1 comprises a positioning configuration in the form of two guide slots 15 (see the enlarged detail in FIG. 3) mutually facing each other and adapted to receive said lateral edges 18 of the auxiliary board 8 inserted in a sliding manner. The mentioned guide slots 15 are formed in a structure 26 of the base body 1 extending inside the shank 21 of the base body 1 and also inside said hollow stem 24 of the actuating assembly 5 parallel to the movement direction of the actuating assembly 5 with respect to the base body 1. The base body 1 also includes a securing configuration in the form of a protuberance 16 arranged on an elastic tab 19 situated between the mentioned mutually facing guide slots 15. In turn, the auxiliary board 8 comprises a securing configuration in the form of a hole 17 adapted and arranged to receive said protuberance 16 in order to secure the auxiliary board 8 by snap fit coupling to the base body 1 when the auxiliary board 8 is positioned with respect to the base body 1. The mentioned protuberance 16 is placed in the path of the auxiliary board 8 and has an entry chamfer 20. When the auxiliary board 8 is inserted into the guide slots 15, the first upper end edge of the auxiliary board 8 impinges on said entry chamfer 20 and an insertion force applied to said entry chamfer 20 by the auxiliary board 8 forces an elastic deformation of said elastic tab 19 sufficient to permit the auxiliary board 8 to pass. Hole 17 in the auxiliary board 8 is located in the path of the protuberance 16 so that when the auxiliary board 8 slides along the guide slots 15 and reaches a correct position with respect to the base body 1, the hole 17 coincides with the protuberance 16 to allow insertion of the protuberance 16 into the hole 17 by elastic recovery of the elastic tab 19.

When the auxiliary board 8 is positioned and secured with respect to the base body 1 (FIG. 6), the light source 6 adjacent to the first upper end edge of the auxiliary board 8 is located at an upper end of said structure 26, next to said translucent or transparent cover 7 of the actuating assembly 5 and directly facing the same, while the region 10 where the contacts 9 are located, which is adjacent to said second lower end edge of the auxiliary board 8, protrudes from a lower end of said structure 26 (FIG. 4) in a suitable position for insertion inside the receptacle of the connector 12 for connecting the contacts 9 of the auxiliary board 8 to the terminals 14 of connector 12. The auxiliary board 8 remains incorporated to the base body 1. When the base body 1 has the auxiliary board 8 incorporated into the same and the support board 4 is positioned with respect to the base body 1, the region 10 of the auxiliary board 8, where the contacts 9 are located, is automatically inserted into the receptacle of the connector 12 in order to connect the contacts 9 to the terminals 14. Inversely, when the support board 4 is removed from the base body 1, the region 10 of the auxiliary board 8 is automatically disconnected from the connector 12 while the auxiliary board 8 remains secured to the base body 1 in its correct position.

One skilled in the art would be able to introduce variations and modifications to the exemplary embodiment described and shown without departing from the scope of the present invention as defined in the attached claims.

The invention claimed is:

1. A lighted pushbutton-type switch assembly comprising:

a base body adapted to be secured to a panel;

a support board incorporating a circuit and a switch connected to said circuit, said support board being adapted to be positioned with respect to said base body and fixed thereto;

an actuating assembly mounted in a linearly movable manner on said base body and adapted to be pushed to operate said switch; and a light source mounted on an auxiliary board, said light source being connected to the circuit of said support board and arranged to emit light through a translucent or transparent cover provided on said actuating assembly, wherein:

said auxiliary board is adapted to be positioned with respect to the base body and fixed thereto, said auxiliary board having conductors connected to said light source and terminated in contacts arranged in a region adjacent to an edge of said auxiliary board; and the support board has a connector comprising terminals connected to said circuit, said region of the auxiliary board where said contacts are located being adapted to be coupled to said connector by introducing said edge and said adjacent region of said auxiliary board into said connector in order to connect said contacts to said terminals when the auxiliary board is fixed to the base body and the support board is positioned with respect to the base body.

2. The assembly according to claim 1, wherein the base body comprises at least one positioning configuration adapted to cooperate with at least part of an outline region of the auxiliary board to position the auxiliary board with respect to the base body and at least one securing configuration adapted to cooperate with at least one corresponding securing configuration formed on the auxiliary board to fix the auxiliary board to the base body by snap fit coupling when the auxiliary board is positioned with respect to the base body.

3. The assembly according to claim 2, wherein the auxiliary board has an elongated form delimited by two lateral edges and first and second end edges, with the light source being adjacent to said first end edge and said region where said contacts are located being adjacent to the second end edge, and in that said base body positioning configuration comprises two guide slots mutually facing and adapted to receive said lateral edges of the auxiliary board inserted in a sliding fashion.

4. The assembly according to claim 3, wherein the mentioned base body securing configuration comprises a protuberance arranged on an elastic tab between said mutually facing guide slots and said auxiliary board securing configuration comprises a hole adapted and arranged to receive said protuberance when the auxiliary board is positioned with respect to the base body.

5. The assembly according to claim 4, wherein the protuberance has an entry chamfer adapted to force sufficient elastic deformation of said elastic tab to allow the auxiliary board to pass as a result of an insertion force applied to said entry chamfer by the auxiliary board when the auxiliary board is inserted into the guide slots.

6. The assembly according to claim 5, wherein said hole is located in the auxiliary board in the path of the protuberance and in a position so as to coincide with that of the protuberance when the auxiliary board is positioned with respect to the base body to allow insertion of the protuberance in the hole by elastic recovery of the elastic tab.

7. The assembly according to claim 4, wherein the base body comprises a shank adapted to pass through a hole in said panel and a bezel with a rear surface adapted to be supported on an exposed side of the panel around said hole, and an actuating assembly comprising a hollow stem adapted to be inserted inside said shank and a pushbutton adapted to be at least partly received in said bezel of the base body, and in that said guide slots are formed in a structure of the base body that extends inside the shank of the base body and inside said hollow stem of the actuating assembly parallel to a movement direction of the actuating assembly with respect to the base body.

8. The assembly according to claim 4, wherein the light source adjacent to the first end edge of the auxiliary board is situated at one end of said structure close to said translucent or transparent cover of the actuating assembly and the region adjacent to said second end edge of the auxiliary board projects from an opposite end of said structure when the auxiliary board is positioned on the base body.

9. The assembly according to claim 8, wherein the base body comprises, at one end of the shank opposite the bezel, a surface adapted to be supported on the support board and elastic arms provided with respective claws configured and arranged to cooperate with corresponding holes in the support board to position and secure the support board with respect to the base body by snap fit coupling.

10. The assembly according to claim 8, wherein the base body comprises claws adapted to cooperate with corresponding elongated holes arranged on elastic tabs formed in the hollow stem of the actuating assembly to retain the actuating assembly on the base body and limit a movement path of the actuating assembly with respect to the base body between an extended position and a retracted position, an elastic element being located between the actuating assembly and the base body to push the actuating assembly towards said extended position.

11. The assembly according to claim 1, wherein said support board and said auxiliary board are printed circuit boards.

* * * * *